US008602012B2

(12) United States Patent
Yang

(10) Patent No.: US 8,602,012 B2
(45) Date of Patent: Dec. 10, 2013

(54) CAR ENGINE AIR-INTAKE UNIT

(76) Inventor: Chung-Yu Yang, Taipei (TW)

( * ) Notice: Subject to any disclaimer, the term of this patent is extended or adjusted under 35 U.S.C. 154(b) by 358 days.

(21) Appl. No.: 12/939,433

(22) Filed: Nov. 4, 2010

(65) Prior Publication Data

US 2011/0120435 A1 May 26, 2011

(30) Foreign Application Priority Data

Nov. 20, 2009 (TW) ..... 98139499 A

(51) Int. Cl.
*F02D 7/00* (2006.01)
*F02M 29/00* (2006.01)
*F02M 29/04* (2006.01)

(52) U.S. Cl.
USPC ..... 123/590; 123/306; 123/593

(58) Field of Classification Search
USPC ..... 123/306, 590, 593
See application file for complete search history.

(56) References Cited

U.S. PATENT DOCUMENTS 4,361,128 A * 11/1982 Goldman et al. ..... 123/592
4,770,151 A * 9/1988 Finlay ..... 123/590
5,113,838 A * 5/1992 Kim ..... 123/592
5,947,081 A * 9/1999 Kim ..... 123/306
5,979,395 A * 11/1999 Mallen et al. ..... 123/243
6,258,144 B1 * 7/2001 Huang ..... 55/385.3
6,758,461 B1 * 7/2004 Omarsson ..... 261/50.1
6,840,212 B2 * 1/2005 Kim ..... 123/306
7,730,997 B2 * 6/2010 Asada et al. ..... 181/270
7,909,027 B2 * 3/2011 Livingston ..... 123/590
2004/0244765 A1 * 12/2004 Elmer ..... 123/244
2008/0178854 A1 * 7/2008 Russell ..... 123/590

OTHER PUBLICATIONS

Thomas & Betts, A History, Scene 7 E-Catalog, www.thomasbetts.com/pub/node/892—then click history to go to catalog made by Scene7, page describing Thomas & Betts invention of the cable tie in 1958.*

Auto-Wares Inc., AP Exhaust Techonolgies, Nov. 15, 2012, Auto-Wares Inc., Air Tube Saddle Clamps, p. 1 of 2. Website www.autoparts2020.com/rsdev/ dated back to Dec. 5, 2008 by the WayBack machine website.*

* cited by examiner

*Primary Examiner* — Lindsay Low
*Assistant Examiner* — Charles Brauch

(57) ABSTRACT

A car engine air-intake unit has a round main body. The main body has airflow guides and airflow guiding plates to guide air flowing into the intake tube to rotate, and blades are provided which protrude out of the main body and extend from the airflow guiding plates to increase the rotating angle and stroke of the guided air flow. The intake unit can be used in cooperation with any of various specific air-intake tubes, and can be assembled and adjusted to support different air intake amounts and any of various air-intake tubes of different bores, and thus offers convenience of use.

9 Claims, 8 Drawing Sheets

CAR ENGINE AIR-INTAKE UNIT

BACKGROUND OF THE INVENTION

1. Field of the Invention

The invention relates to a unit for a car engine, and especially to a car engine air-intake unit able to increase the scattering of molecules in the air flow.

2. Description of the Prior Art

For the purpose of getting increased air intake amounts when an engine runs at a high speed, there have been various airflow guides provided on the front ends of intake tubes offered on the market, in order to render air entering each intake tube to flow and rotate at a specific angle; such a flowing and rotating air current can pass through with a higher speed when it enters an engine, and can thereby increase the intake amount into the engine, and thus the engine combustion chamber can get better combustion and compression effects.

Each of the above mentioned conventional airflow guides may have a function of speeding up air intake, however, due to inferior designs, they suffer from the defect of having the air flow near the axis of the intake tube and the flow far from the axis of the intake tube distributed in a non-uniform manner; such non-uniformity may create the situation such that when a user adds an air catalyst or some other combustion supporting material (for instance nitrogen oxide ($N_2O$)) on the intake side of the engine, the air catalyst or the combustion supporting material will be unable to uniformly diffuse to provide its desired effect.

Hence there further have been offered an improved airflow guide on the market, such as shown in FIG. 1. The airflow guide at least comprises a main body 1 in the shape of a rounded disc; a ring 2 is provided outside of the main body 1 to be fixed on the inner rim of an intake tube 3. The ring 2 is provided therein with a plurality of airflow guiding holes 4. The airflow guiding holes 4 are arranged at least in two lines to form the shape of a grid, and each of the airflow guiding holes 4 has therein at least an airflow guiding plate 5 having a tilting angle relative to the axial direction of the intake tube 3; when inflowing air flow entering the intake tube 3 passes through the main body 1, it is guided by the airflow guiding holes 4 and the airflow guiding plate 5 to rotate and flow in the intake tube 3 with a specific angle, and will not be concentrated in the area far from the axis of the intake tube 3, and thus the amount of the intake air can be uniformly distributed in the axis of the intake tube and the area far from the axis of the intake tube 3.

Although the above conventional current guide solved the problem of non-uniform distribution of the amount of air flow near the axis of the intake tube 3 and far from the axis of the intake tube 3, by virtue that the inflowing air in the intake tube 3 flows very fast to supply air for the engine, a user can not uniformly distribute the air catalyst or the combustion supporting material being added into the airflow, which is flowing very fast, and thus the air catalyst or the combustion supporting material is still unable to obtain optimum effects.

In view of these, the inventor of the present invention studied on the related field and based on his experience of years to provide a car engine air-intake unit in order to solve the above discussed problem; the invention can make the air molecules in the intake tube be distributed more uniformly, and thereby provide improved use.

SUMMARY OF THE INVENTION

An object of the present invention is to provide a car engine air-intake unit that can increase the effect of scattering air in the intake tube, and can multiply the effect of scattering of the air, and thus achieve convenience of use.

In order to achieve the above-mentioned object, a car engine air-intake unit of an embodiment of the present invention can be provided on the inner rim of an intake tube and comprises at least a main body in the shape of a rounded disc. The main body is provided thereon with a plurality of airflow guides and airflow guiding plates to guide an air flow to enter the intake tube and to flow and rotate, and blades are provided to protrude from the main body and extend from the current guiding plates to increase the rotating angle and stroke of the guided air flow, and further, the main body is provided on an outer surface of the circular ring with an adjusting member to allow the main body to be engaged in an inner rim of one of various types of intake tubes. Wherein:

The main body has a circular ring which can be fixed on the inner rim of an intake tube. The ring is provided with a plurality of airflow guiding holes, and the airflow guiding holes each has therein at least an airflow guiding plate having a tilting angle relative to the axial direction of the intake tube; when the air flow entering the intake tube gets through the main body, it is guided by the airflow guiding holes and the airflow guiding plates to rotate and flow in the intake tube in a specific angle, and will not be concentrated at the area far from the axis of the intake tube.

The above mentioned blades are formed to protrude out of the airflow guiding plates on the main body. When the intake air flow entering the intake tube of the car is guided by the airflow guiding holes and the airflow guiding plates to rotate and flow out of the airflow guiding holes, the blades will extend the effect of guiding and rotating the air flow to increase the rotating angle of the air flow; and when the air flow gets through the blades, it is cut and separated into a plurality of fine vortexes. These fine and disordered vortexes cause the flowing air to scatter in all directions, to thereby make the added air catalyst on the intake end of the intake tube uniformly spread across the air flow.

In practice, the contour of the blades can match with the bores of the airflow guiding holes, in order that when two main bodies are leaned against each other, one main body can have its blades engaged in the airflow guiding holes of the other main body, so that the two main bodies can be connected with each other conveniently.

The above mentioned adjusting member is provided on the outer surface of the above mentioned circular ring, in order that the embodiment of the present invention can freely cooperate with any intake tube among various intake tubes with different bores, to save costs of opening mould. In practicing, the adjusting member can be a "C" shaped ring of any of various thicknesses able to be engaged between the intake tube and the circular ring; by virtue that the "C" shaped ring nestles between the inner rim of the intake tube and the outer surface of the circular ring, it impedes flowing of the air flow in a space between the circular ring and the intake tube, so that the air flow can more concentratively flow from the above mentioned airflow guiding holes to go along the blades, thereby assuring a more uniform distribution of air in the intake tube.

Moreover, in practicing an embodiment of the present invention, the intake end of the main body can be provided with an annular stop piece which can be in a shape of a "C" having a notch in order to be engaged in any of various air-intake tubes of different bores, and can impede flowing of the air flow in the space between the circular ring and the intake tube. The annular stop piece can also render the air flow on the end of the intake tube to flow more concentratively to the center of the main body, in order that the turbulence effect of the main body can be more evident.

For the convenience of assembling, in practicing of an embodiment of the present invention, at least an elongate fixing piece can be provided. The elongate fixing piece is provided on one end with a blocking piece; the other end of the elongate fixing piece is pulled through an airflow guiding hole at the lateral side of a main body, and is pulled outwards after passing the top edge of the circular ring of the main body, so that when the blocking piece blocks the intake end of the main body, the elongate fixing piece is pressed tight by an originally provided element of the air-intake tube of the car, and assembly is completed. A user can perform assembling and disassembling by himself, and thus the effect of convenient assembling can be achieved.

As compared with the conventional techniques, in view that embodiments of the present invention can effectively scatter the air, the air catalytic added to the intake end can more uniformly contact each molecule within the air flow; and the various embodiments of the present invention can make assembling and adjusting by using different air intake amounts and any of various air-intake tubes of different bores; they thus have the advantage of convenience of use.

The present invention will be apparent in its technical measures after reading the detailed description of the preferred embodiment thereof in reference to the accompanying drawings.

DETAILED DESCRIPTION OF THE PREFERRED EMBODIMENT

Figure 1:
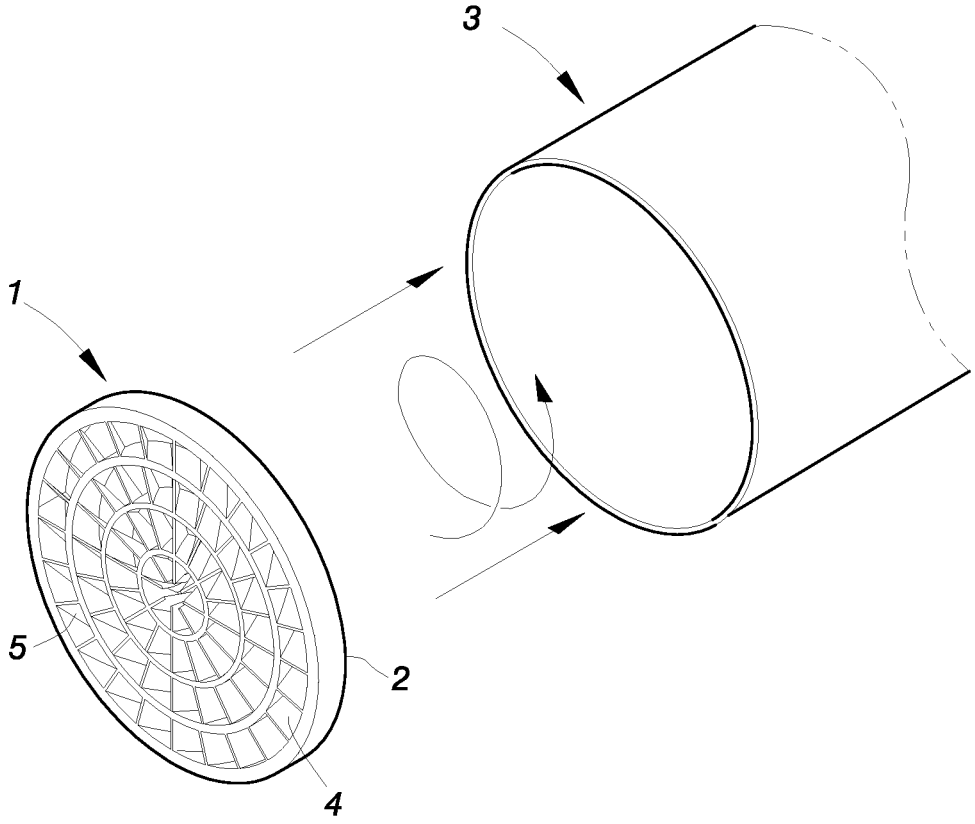
PRIOR ART FIG.1
FIG. 1 is a perspective schematic view showing the structure of a conventional airflow guide for an engine air-intake.
Figure 2:
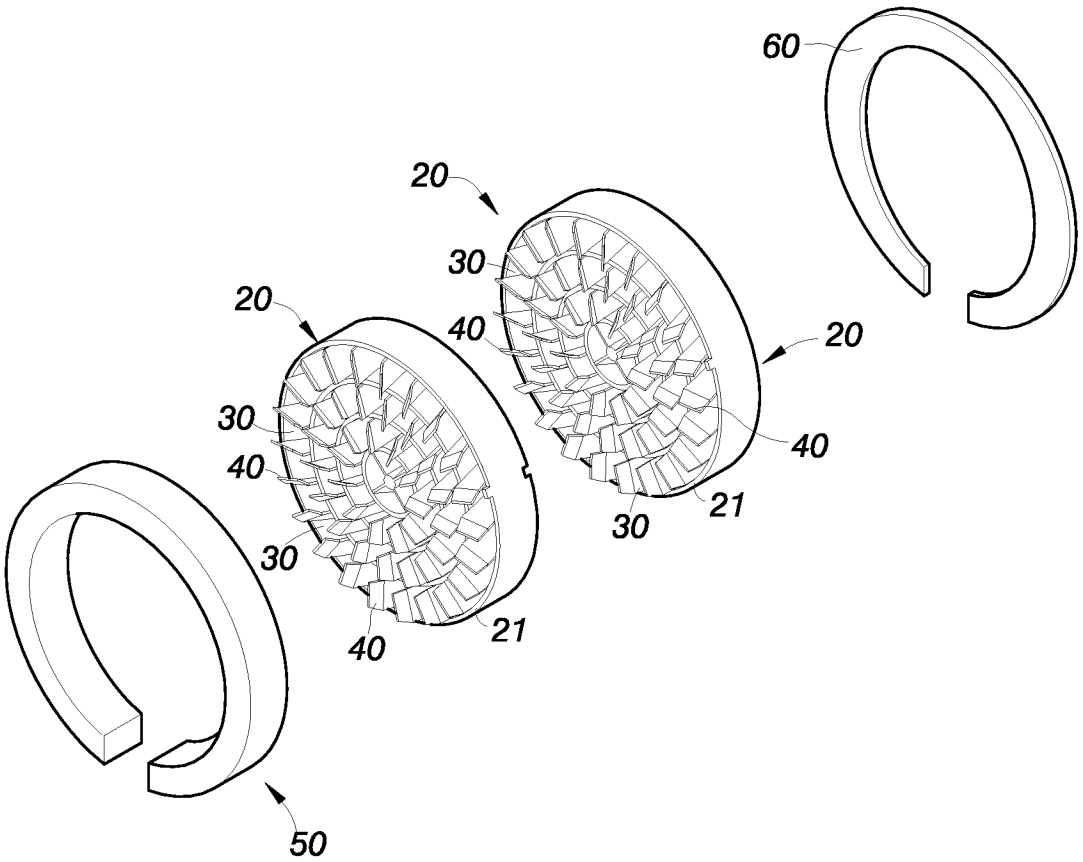
FIG. 2 is an exploded perspective view of an embodiment of the present invention.
Figure 3:
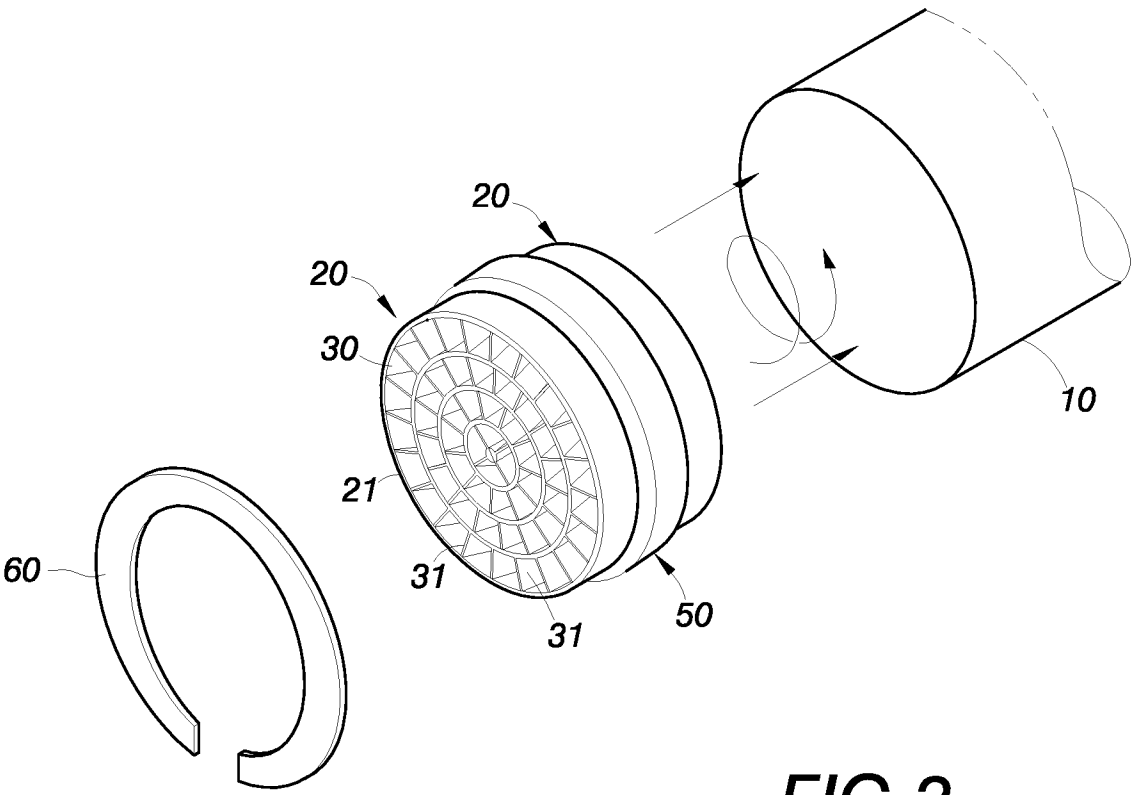
FIG. 3 is an exploded perspective schematic view showing an intake tube of an embodiment of the present invention.
Figure 4:
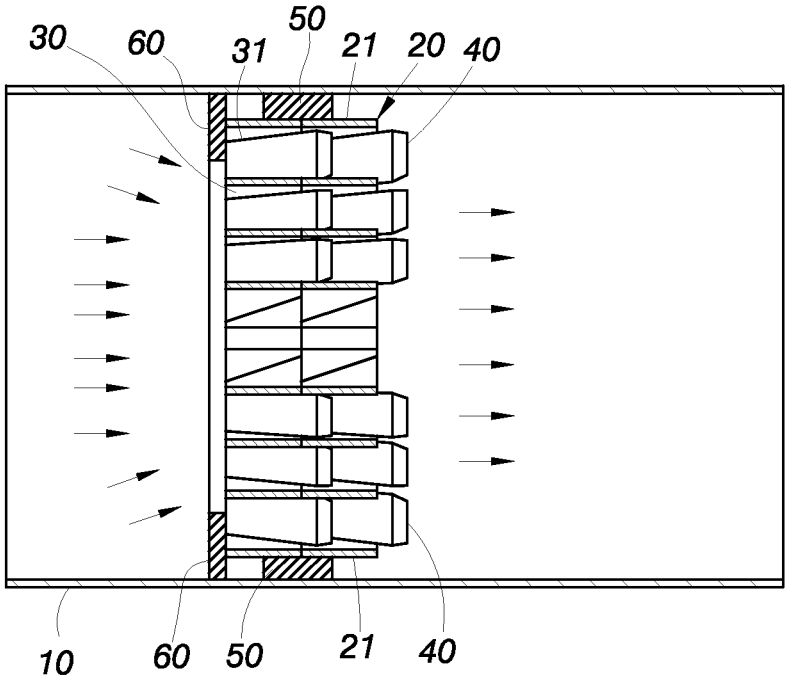
FIG. 4 is a schematic plan view showing the intake tube of an embodiment of the present invention.

Referring to FIGS. 2 to 4, a car engine air-intake unit of an embodiment of the present invention can be provided in the inner rim of an intake tube 10, and comprises at least a main body 20 in a shape of round disc. The main body 20 is provided thereon with a plurality of airflow guides 30 and airflow guiding plates 31 to guide air flow to enter the intake tube 10 and to flow and rotate. The airflow guiding plates 31 have blades 40 which protrude out of the main body 20 and extend from the airflow guiding plates 31 forwards and rearwards to increase the rotating angle and stroke of the guided air flow, and more, the main body 20 is provided on an outer surface of a circular ring 21 with an adjusting member 50 to allow the main body 20 to be engaged in an inner rim of one of various intake tubes 10. The intake end of the main body 20 can be provided with an annular stop piece 60. Wherein:

The main body 20 has therearound the circular ring 21 which can be fixed on the inner rim of an intake tube 10. The ring 21 is provided therein with a plurality of airflow guiding holes 30, and the airflow guiding holes 30 each has therein at least a airflow guiding plate 31 having a tilting angle relative to the axial direction of the intake tube 10; when the intake air flow entering the intake tube 10 gets through the main body 20, it is guided by the airflow guiding holes 30 and the airflow guiding plates 31 to rotate and flow in the intake tube 10 in a specific angle, and will not be concentrated at the area far from the axis of the intake tube 10.

The above mentioned blades 40 are formed to protrude out of the airflow guiding plates 31 on the main body 20. When the intake air flow entering the intake tube 10 of the car is guided by the airflow guiding holes 30 and the airflow guiding plates 31 to rotate and flow out of the airflow guiding holes 30, the blades 40 will continue the stroke of guiding and rotating the air flow to increase the rotating angle of the air flow; and when the air flow gets through the blades 40, it is cut and separated into a plurality of fine vortexes. These fine and disordered vortexes cause scattering of the air flow molecules in every direction, to thereby make the added air catalyst on the intake end uniformly contact each molecule within the air flow.

In practice, the contour of the blades 40 can align with the bores of the airflow guiding holes 30, so that when two main bodies 20 are abutted against each other, one main body 20 can have its blades 40 engaged in the airflow guiding holes 30 of the other main body 20, so that the two main bodies 20 can be connected with each other conveniently.

The above mentioned adjusting member 50 is provided on the outer surface of the above mentioned circular ring 21, in order that the present invention can freely cooperate with any intake tube 10 among various intake tubes 10 with different bores, to avoid wasted costs of opening mould. In practice, the adjusting member 50 can be a "C" shaped ring of any of various thicknesses able to be engaged between the intake tube 10 and the circular ring 21; by virtue that the "C" shaped adjusting member 50 nestles between the inner rim of the intake tube 10 and the outer surface of the circular ring 21, it impedes flowing of the air flow in a space between the circular ring 21 and the intake tube 10, so that the air flow can more concentratively flow through the above mentioned airflow guiding holes 30 to go along the blades 40, and thereby the air molecules in the intake tube 10 can be assured to be distributed more uniformly.

Moreover, the intake end of the main body 20 can be provided with the above mentioned annular stop piece 60 which can be in the shape of a "C" having a notch in order to be engaged in any of various air-intake tubes 10 of different bore sizes, and can impede flowing of the air flow in the space between the circular ring 21 and the intake tube 10. The annular stop piece 60 can also render the air flow on the end of the intake tube 10 to flow more concentratively to the center of the main body 20, in order that the turbulence effect of the main body 20 can be more evident.

Figure 5:
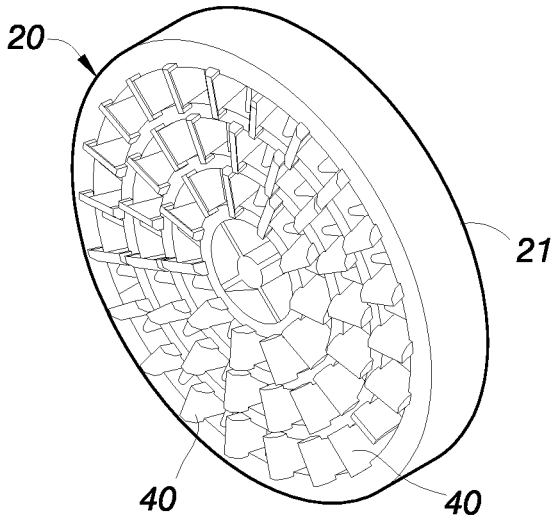
FIG. 5 is a perspective schematic view showing another embodiment of the present invention.
Figure 6:
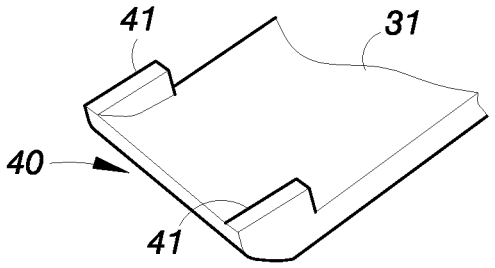
FIG. 6 is an enlarged perspective view showing a rib piece of an embodiment of the present invention.

Referring to FIGS. 5 and 6, the blades 40 may extend from the airflow guiding plates 31 forwards and rearwards and each has an arc-shaped profile or is tilted. The blades 40 can be provided on each of two sides of its inwardly bending or tiling areas with rib pieces 41 for increasing the structural strength of the blades 40. These rib pieces 41 can eliminate the problem of breakage of the blades 40 because of insufficient strength or breakage occurring in manufacturing.

Figure 7:
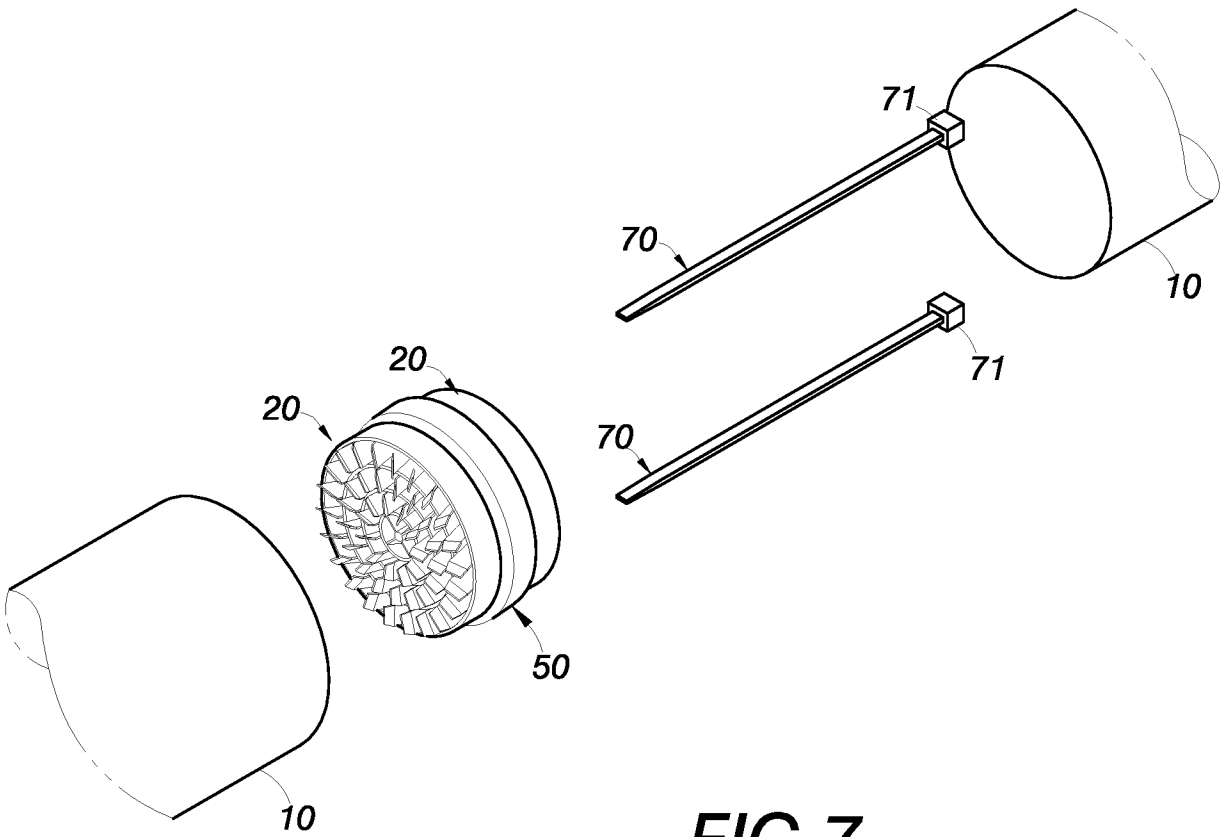
FIG. 7 is an exploded perspective view showing a fixing piece of an embodiment of the present invention.
Figure 8:
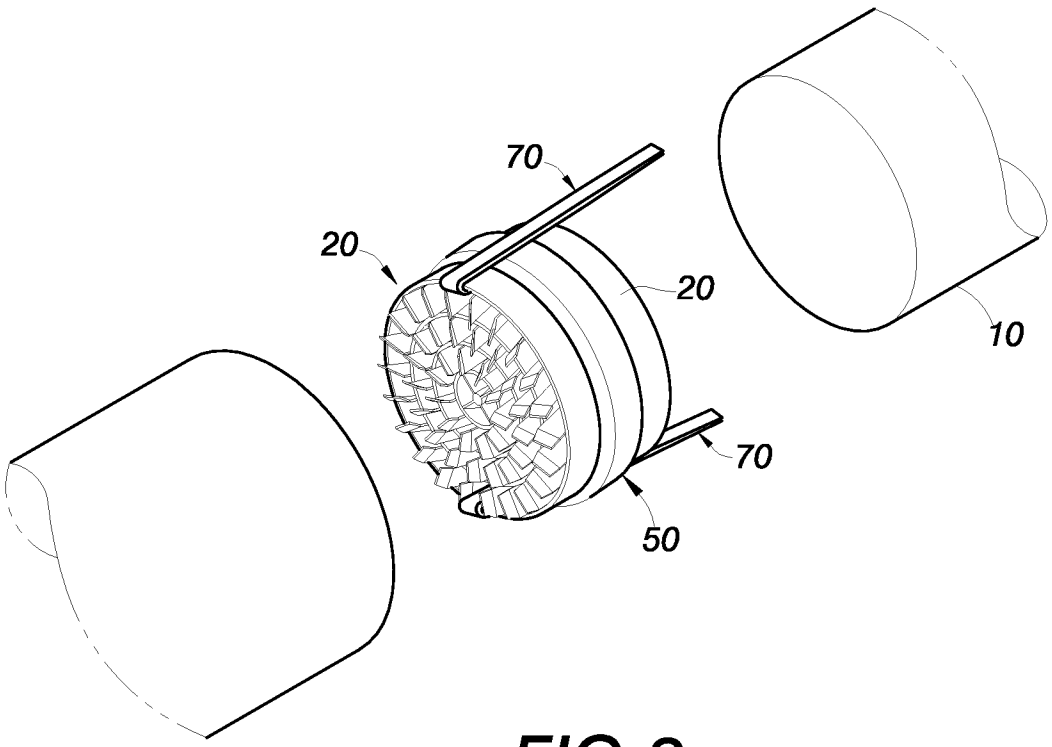
FIG. 8 is a perspective schematic showing use of the fixing piece of an embodiment of the present invention.
Figure 9:
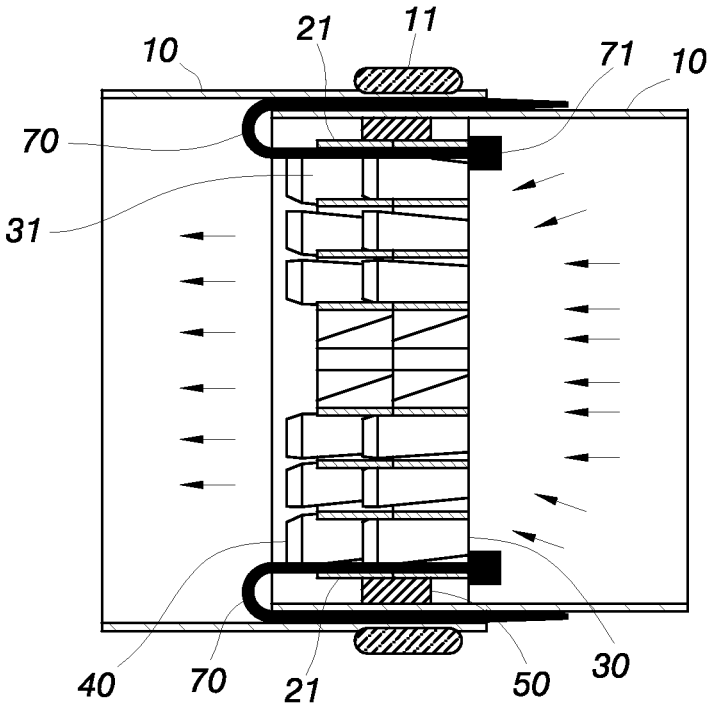
FIG. 9 is a schematic plan view showing assembling of the fixing piece of an embodiment of the present invention.

Referring to FIGS. 7 to 9, for the convenience of assembling, at least an elongate fixing piece 70 can be provided. The elongate fixing piece 70 is provided on one end of with a blocking piece 71; the other end of the elongate fixing piece 70 is pulled through an airflow guiding hole 30 on the lateral side of a main body 20, and is pulled outwards after passing the top edge of the circular ring 21 of a main body 20, so that when the blocking piece 71 blocks the intake end of the main body 20, the elongate fixing piece 70 is pressed tight by an originally provided element 11 of the air-intake tube 10 of the car, and assembling is completed. A user can perform assembling and disassembling by himself, and thus the effect of convenient assembling can be achieved. As depicted in the drawings, two elongate fixing pieces 70 are provided respectively on the two lateral sides of the main body 20, for the purpose that the main body 20 can be firmly fixed on the intake tube 10 of the car.

The embodiments presented and the content shown in the drawings are only for illustrating a preferred embodiment of the present invention, and not for indicating any limitation such as in appearance, shape (which can be varied in pursuance of the requirement of the shape of the intake tube) to the scope of the present invention. It will be apparent to those skilled in this art that various equivalent modifications or changes without departing from the spirit of this invention shall also fall within the scope of the appended claims.

What is claimed is:

1. An engine air-intake unit for engaging with an intake tube, the air-intake unit comprising at least a main body in a shape of a round disc, a circular ring circumferentially surrounding the main body, the main body including a plurality of airflow columns extending axially through the entire axial length of the main body and configured to scatter air flowing through a volume bounded by the circular ring, each airflow column having therein at least an airflow guiding plate for adjusting a direction of the air flowing through the volume, each airflow guiding plate having at least a blade which protrudes axially out of said main body beyond axial extents of the circular ring and extends from the corresponding airflow guiding plate to increase a rotation of air flowing through the air-intake unit.

2. The engine air-intake unit as claimed in claim 1, further comprising an adjusting member disposed over the circular ring to engage an inner surface of said intake tube.

3. The engine air-intake unit as claimed in claim 2, wherein the adjusting member is a C-shaped ring.

4. The engine air-intake unit as claimed in claim 1, wherein contours of said blades align with bores of said airflow columns for mechanical engagement with airflow columns of another main body.

5. The engine air-intake unit as claimed in claim 1, wherein said blades are provided on at least two sides with rib pieces.

6. The engine air-intake unit as claimed in claim 1, wherein an intake end of said main body is provided with an annular stop piece.

7. The engine air-intake unit as claimed in claim 6, wherein said annular stop piece is C-shaped with a notch.

8. The engine air-intake unit as claimed in claim 1, wherein at least an elongate fixing piece is provided in a first airflow column on a lateral side of said main body, said elongate fixing piece having a blocking piece on one end, another end of said elongate fixing piece configured to pass through the first airflow column and pass a top edge of said circular ring, so that when the blocking piece abuts the intake end of the main body, the elongate fixing piece is pressed by an element of said air-intake tube of said car.

9. The engine air-intake unit as claimed in claim 8, wherein another elongate fixing piece is further provided, the two elongate fixing pieces disposed at two mutually opposite positions.

* * * * *